US009032563B2

(12) United States Patent
Lee

(10) Patent No.: US 9,032,563 B2
(45) Date of Patent: May 19, 2015

(54) APPARATUS AND METHOD FOR TREATING EXCRETA

(75) Inventor: Jong-Chan Lee, Gyeonggi-do (KR)

(73) Assignee: Curaco, Inc., Seoul (KR)

( * ) Notice: Subject to any disclaimer, the term of this patent is extended or adjusted under 35 U.S.C. 154(b) by 844 days.

(21) Appl. No.: 13/319,017

(22) PCT Filed: May 7, 2010

(86) PCT No.: PCT/KR2010/002896
§ 371 (c)(1),
(2), (4) Date: Nov. 4, 2011

(87) PCT Pub. No.: WO2010/128813
PCT Pub. Date: Nov. 11, 2010

(65) Prior Publication Data

US 2012/0110725 A1 May 10, 2012

(30) Foreign Application Priority Data

May 7, 2009 (KR) ..... 10-2009-0039629
Aug. 11, 2009 (KR) ..... 10-2009-0073769
Aug. 11, 2009 (KR) ..... 10-2009-0073772

(51) Int. Cl.
*A61G 9/00* (2006.01)

(52) U.S. Cl.
CPC .. *A61G 9/00* (2013.01); *A61G 9/003* (2013.01)

(58) Field of Classification Search
CPC ..... A61G 9/003
USPC ..... 4/450–457, 661
See application file for complete search history.

(56) References Cited

U.S. PATENT DOCUMENTS 5,681,297 A 10/1997 Hashimoto et al.
2008/0178377 A1 7/2008 Liu

FOREIGN PATENT DOCUMENTS

| | | | |
|---|---|---|---|
| EP | 1872752 | A1 | 2/2008 |
| JP | 2004321399 | A | 11/2004 |
| JP | 2004324773 | A | 11/2004 |
| JP | 2004329715 | | 11/2004 |
| JP | 2006132565 | A | 5/2006 |
| JP | 2008209009 | A | 9/2008 |
| KR | 100709961 | B1 | 4/2007 |
| KR | 10-0882810 | B1 | 2/2009 |

*Primary Examiner* — Lori Baker
(74) *Attorney, Agent, or Firm* — Senniger Powers LLP

(57) ABSTRACT

Apparatus and method for automatically receiving and treating excreta. The apparatus for treating excreta according to the present invention includes: a port with an excreta-receiving portion for receiving the excreta of patients; an excreta storage unit which suctions and stores excreta from the excreta-receiving portion; an excreta suctioning unit which is connected to the excreta storage unit; a wash water supply unit which supplies wash water to the port, wherein the port has an air spray nozzle and an air intake port connected to an air intake line; and a flow channel switching unit, one side of which is selectively connected either to the excreta suctioning line or to the air intake line which are connected through the excreta storage unit, and the other side of which is connected to the excreta suctioning unit.

27 Claims, 14 Drawing Sheets

FIG. 7
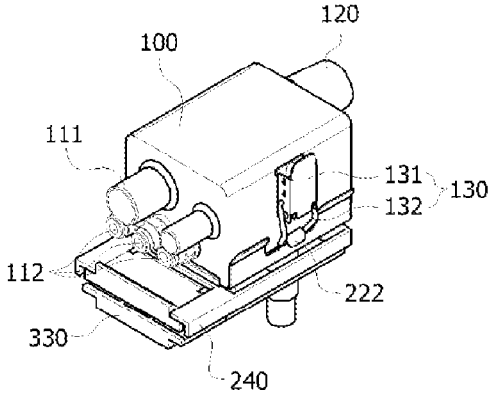
[FIG. 8
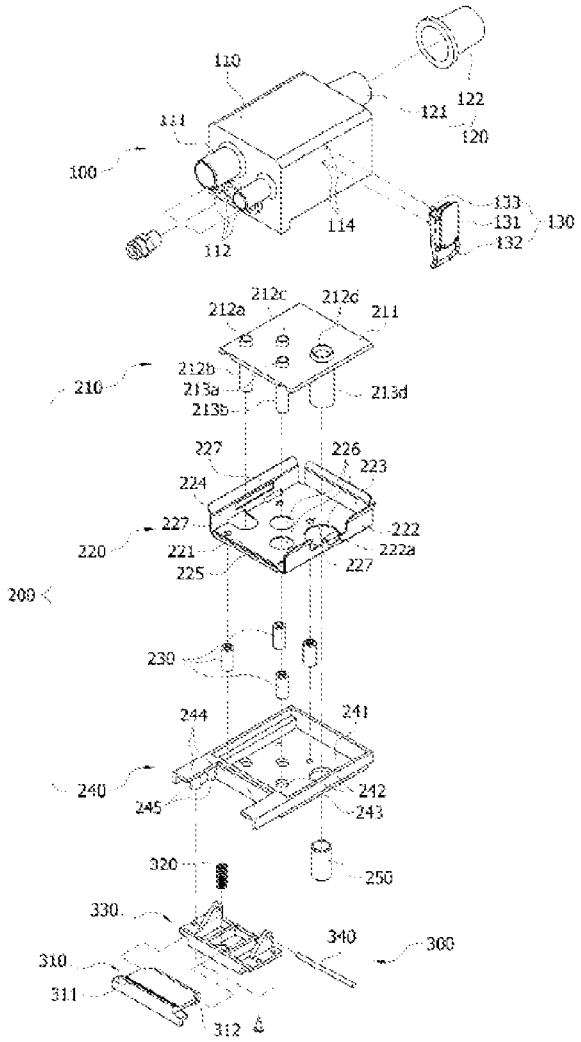

APPARATUS AND METHOD FOR TREATING EXCRETA

TECHNICAL FIELD

The present invention relates to an apparatus and a method for treating excreta, particularly an apparatus and a method for automatically receiving and treating excreta from patients.

BACKGROUND ART

In general, apparatuses for treating excreta which can automatically treat excreta have been developed for patients who cannot treat excreta by themselves due to medical operations in hospitals or old people who have difficulty in movement.

Such apparatuses for treating excreta include a port that is formed in a diaper shape to receive excreta of a patient and retain the patient's hip and a control device unit that controls storage of excreta that is vacuum-suctioned from the port or supply of wash water for washing the patient's hip to the port.

The control device unit includes an excreta storage unit that is connected with the port and stores the excreta at the port, an excreta suctioning unit that is connected to the excreta storage unit to vacuum-suction the excreta in the port; and a wash water supply unit that supplies wash water to wash the excreta and a bidet.

As an example of the apparatus for treating excreta, an "automatic excreta treating apparatus" has been disclosed in Japanese Patent Application Laid-Open Publication No. 2002-58692.

The automatic excreta treating apparatus includes a port that is made of synthetic resin and can come in close contact to the pelvic region of a human body and a control device unit that is connected to the port. The port has a treating portion formed at the center portion on the inner surface to collect excreta, a washing nozzle opened to be connected to the treating portion, an excreta suctioning port formed on the bottom of the treating portion, a flat portion formed around the treating portion and hermetically coming in direct contact with a human body, and a belt seating portion formed outside the portions corresponding to both legs of the port. The control device unit is provided with a washing pipe connected to the washing nozzle, a suction pipe connected to an excreta suction port, an excreta tank connected with the suction pipe, a wash water tank connected to the washing pipe, and a pump performing the suction and transporting the wash water.

In the automatic excreta treatment apparatus of the related art, both the air channel for washing the excreta and the air channel for drying pass through the excreta tank. That is, a small pump is operated to dry the inside of the port after the excreta is suctioned into the excreta tank, in which the air at the upper portion in the excreta tank is sprayed through the washing nozzle by the small pump. According to this structure, since the air at the upper portion in the excreta tank has been contaminated, when the air is sprayed into the port, there is a problem in that it is difficult to keep cleanliness for the patient and the room where there is a patient becomes contaminated.

Further, only the wash water is sprayed through the washing nozzle for washing the excreta, such that there is a problem in that the excreta in the treating portion is not completely removed.

Meanwhile, a plurality of tubes are connected between the port and the control device unit to suction/supply the air and wash water.

The excreta in the port is suctioned into the excreta storage unit of the control device unit through any one of the tubes. Further, the wash water supplied from the wash water supply unit of the control device unit washes the excreta or washes the patient's hip while being supplied into the port through any one or more of the tubes.

For this operation, the tubes are connected to the inside of the main body, that is the control device unit, but there is a problem in that the joints are structurally complicated and the number of joints correspondingly increases, such that the excreta leaks.

Further, since the connection structure is complicated, it is difficult to separate the excreta storage unit for washing.

In addition, in the automatic excreta treatment apparatus of the related art, the position of the washing nozzle for washing the patient's hip is fixed. However, the positions of the anuses of people or the pelvic region of women when they are lying may be a little different. Therefore, according to the automatic excreta treatment apparatus of the related art, there is a problem in that it is difficult to accurately spray the wash water to a desired position to wash, even though the wash water is sprayed to wash the anus or the pelvic region of a woman.

DISCLOSURE

Technical Problem

The present invention has been made in an effort to provide an apparatus for treating excreta which has an air circulation channel that does not pass an excreta storage unit when circulating air to dry the inside of a port, and a method thereof.

Further, the present invention has been made in an effort to provide an apparatus for treating excreta which has a simple structure by circulating air for suctioning and drying excreta, using one vacuum pump, and a method thereof.

In addition, the present invention has been made in an effort to provide an apparatus and a method for treating excreta which can extend the life span of a filter for purifying air suctioned from an excreta tank when washing excreta.

Furthermore, the prevent invention has been made in an effort to provide an apparatus for treating excreta which prevent excreta from leaking and is easily assembled/dissembled by connecting a port with a control device unit in a simple structure.

Moreover, the present invention has been made in an effort to provide an apparatus for treating excreta that can control the position of a wash water spraying nozzle to accurately spray wash water to a desired position even if the bodily structures of people are different.

Technical Solution

In order to accomplish the objects, an apparatus for excreta of a patient according to the present invention includes: a port 1 with an excreta receiving portion 71 for receiving the excreta of patients; an excreta storage unit 10 which suctions excreta from the excreta receiving portion 71 via an excreta suctioning line 61 and stores the suctioned excreta; an excreta suctioning unit 30 which is connected to the excreta storage unit 10 to vacuum-suction the excreta; a wash water supply unit 50 which supplies wash water to the port 1 to wash excreta and a bidet, in which port 1 has an air spray nozzle 75 for spraying air to the excreta receiving portion 71, and an air intake port 74 for suctioning air from the interior of the port 1, and wherein the air intake port 74 is connected to an air intake line 65; and a flow channel switching unit 20, one side of which is selectively connected either to the excreta suctioning line 61 or to the air intake line 65 which are connected through the excreta storage unit 10, and the other side of which is connected to the excreta suctioning unit 30.

A method of treating excreta of a patient according to the present invention includes: (a) sensing excreta of a patient in the port 1 for receiving excreta of a patient; (b) performing a washing mode for washing the excreta and the patient by operating the excreta suctioning unit 30 for vacuum-suctioning the excreta by sensing the excreta; (c) switching an internal air circulation channel by using the flow channel switching unit 20 after the washing mode is performed; and (d) performing a drying mode of circulating air for drying the inside of the port 1 after the flow channel is switched while the excreta storage unit 10 storing the excreta is blocked.

Advantageous Effects

According to the present invention, it is possible to prevent external air from contaminated by a stink by preventing the air circulated for drying the inside of the port from passing through the excreta storage unit. Further, excreta is suctioned and air for drying is circulated by one vacuum pump, such that the structure is simplified. Further, since the air passing through the filter while the drying mode is performed is not contaminated, the life span of the filter can be extended.

Further, according to the present invention, since the flow channel connection member for connecting the flow channels for air and wash water to the tubes and the base coupled to the lower portion of the flow channel connection member and sliding to the excreta storage unit are provided, it is possible to simply perform assembly/disassembly only by inserting/separating the flow channel connection member into/from the excreta storage unit.

In addition, according to the present invention, since the number of the joints between the flow channel connection member and the excreta storage unit and the number of the joints in the flow paths of the wash water and the air are small, it is possible to prevent leakage of the air and the wash water.

Furthermore, according to the present invention, since it is possible to spray the wash water to a desired position even if the bodily structures of people are different, it is possible to make the patient's hip clean.

DESCRIPTION OF DRAWINGS

FIG. 7 is a perspective view showing when the flow channel connection member and the base according to the present invention are combined by a coupling member.

FIG. 8 is an exploded perspective view showing when the components are dissembled from the state of FIG. 7.

BEST MODE

Hereinafter, the configurations and operations of preferred embodiments of the present invention will be described in detail with reference to the accompanying drawings.

Embodiment 1

Figure 1:
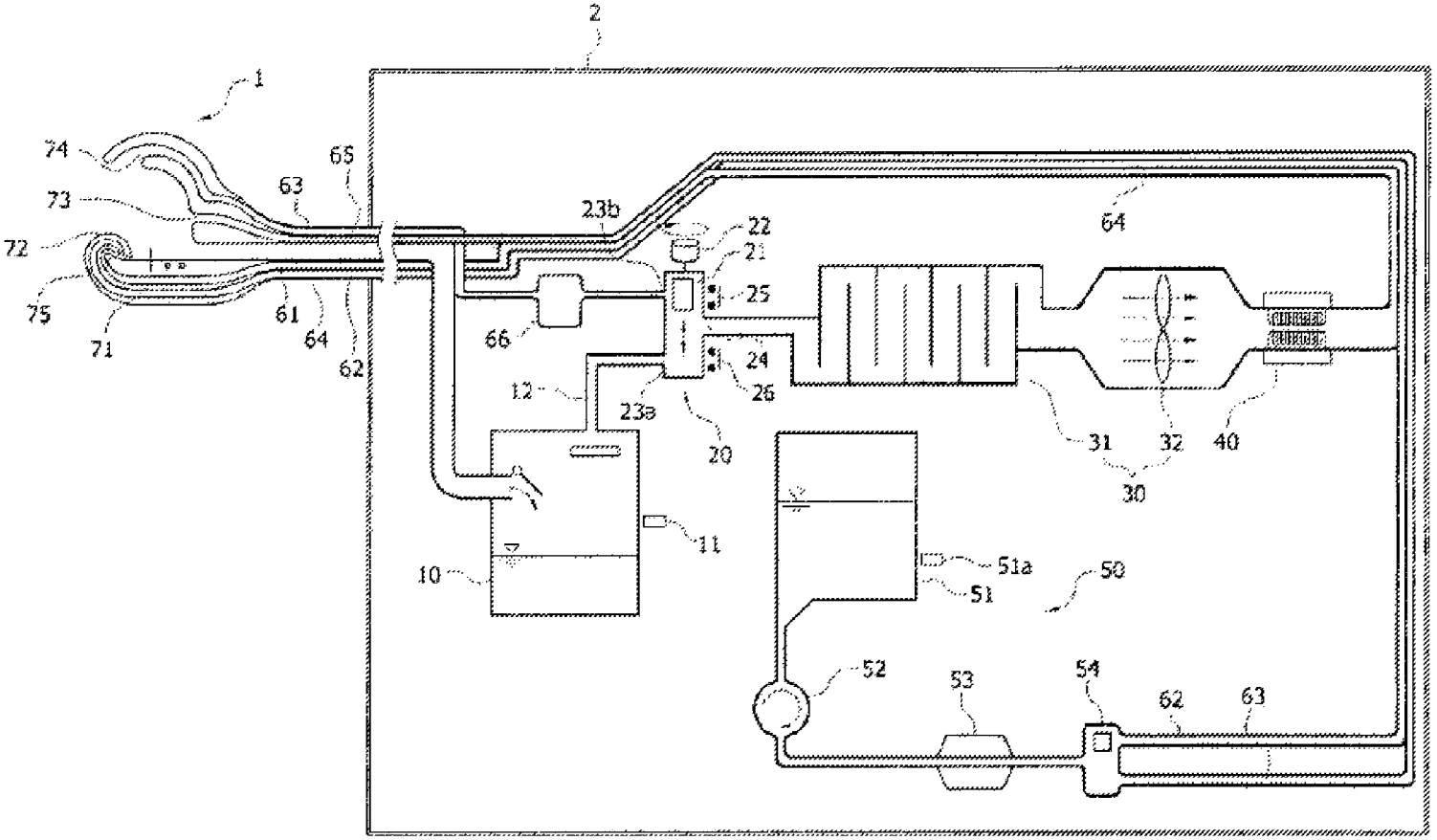
FIG. 1 is a view schematically showing an apparatus for treating excreta according to the present invention.

FIG. 1 is a view schematically showing an apparatus for treating excreta according to the present invention.

An apparatus for treating excreta according to Embodiment 1 of the present invention includes a port 1 that receives excreta from a patient, an excreta storage unit 10 that is connected with the port 1 and stores the excreta, an excreta suctioning unit 30 that is connected to the excreta storage unit 10 and vacuum-suctions the excreta in the port 1, a flow channel switching unit 20 that switches an air circulation channel when washing excreta or drying the port 1, and a wash water supply unit 50 that supplies wash water to wash excreta and a bidet.

The port 1 is formed in a diaper shape to retain the body of a patient (for example, the hip or the crotch). The portion that is brought in contact with the skin is made of an elastic material for close contact with the skin.

An excreta receiving portion 71 where excreta of a patient is collected, an air spray nozzle 75 that sprays air to the excreta receiving portion 71, a wash water spray nozzle 72 that sprays wash water to the excreta receiving portion 71, a bidet nozzle 73 that sprays wash water to the patient's anus and pelvic region, and an air intake port 74 that suctions the air in the port 1 are formed in the port 1.

The excreta receiving portion 71 is connected with an excreta intake line 61 connected to the excreta storage unit 10.

The nozzles in the port 1 are connected with flow channels for air and wash water. That is, the air spray nozzle 75 is connected with a wash air supply line 64 connected to the outlet of the excreta suctioning unit 30 while the air intake port 74 is connected to the air intake line 65 connected to the inlet of the excreta suctioning unit 30. Further, the wash water spray nozzle 72 is connected with the wash water supply line 62 connected with the wash water supply unit 50 while the bidet nozzle 73 is connected with a bidet nozzle line 63 connected with the wash water supply unit 50.

Excreta suctioned by the suction force of the excreta suctioning unit 30 flows into the excreta storage unit 10 through the excreta intake line 61. The excreta storage unit 10 is equipped with an excreta level sensor 11 that senses the level of excreta. The upper portion of the excreta storage unit 10 is an empty space while the excreta storage unit 10 and the flow channel switching unit 20 are connected by a connection pipe 12.

The flow channel switching unit 20 has a first inlet 23*a* connected with the excreta storage unit 10 by the connection pipe 12, a second inlet 23*b* connected with the air intake line 65, a valve unit 21 selectively opening and closing the first and second inlets 23*a* and 23*b*, and an outlet 24 connected to the excreta suctioning unit 30.

The valve unit 21 selectively opens and closes the first inlet 23*a* and the second inlet 23*b* while reciprocating straight by a motor 22.

Limit switches 25 and 26 are disposed at the upper and lower ends of reciprocation section of the valve unit 21, respectively, to restrict the upper and lower positions of the valve unit 21.

The excreta suctioning unit 30 includes a filter 31 connected with the outlet 24 of the flow channel switching unit 20 to purify air, a vacuum pump 32 connected to the outlet side of the filter 31, and a heater 40 heating the air discharged from the vacuum pump 32.

The filter 31 is filled with active carbon to purify the air circulating through the flow channels.

The wash water supply unit 50 includes a wash water storage tank 51 equipped with a water level sensor 51*a*, a pump 52 supplying the wash water in the wash water storage tank 51 to the port 1, a heater 53 heating the wash water to be warm, and a valve 54 selectively supplying the wash water to any one of the wash water supply line 62 and the bidet nozzle line 63.

Meanwhile, a gas sensor 66 may be disposed in the air intake line 65. The gas sensor 66 discriminates between feces, urine, and gas by sensing the pollution level of air in the air intake line 65, and when it is a gas, air is circulated for a predetermined time and the gas sensor 66 senses when it is normal, such that it has only to keep circulating the air without washing with the wash water.

Although the flow channel switching unit 20 is equipped with the valve unit 21 that is opened and closed by the motor 22 in the embodiment, a solenoid valve may be used. That is, a first solenoid valve is connected to the connection pipe 12 and a second solenoid valve is connected to the air intake line 65. In this configuration, a control unit (not shown) opens the first solenoid valve and closes the second solenoid valve when washing excreta. The control unit closes the first solenoid valve and opens the second solenoid valve such that the air passing through the air intake line 65 keeps flowing, in drying after washing the excreta.

Figure 2:
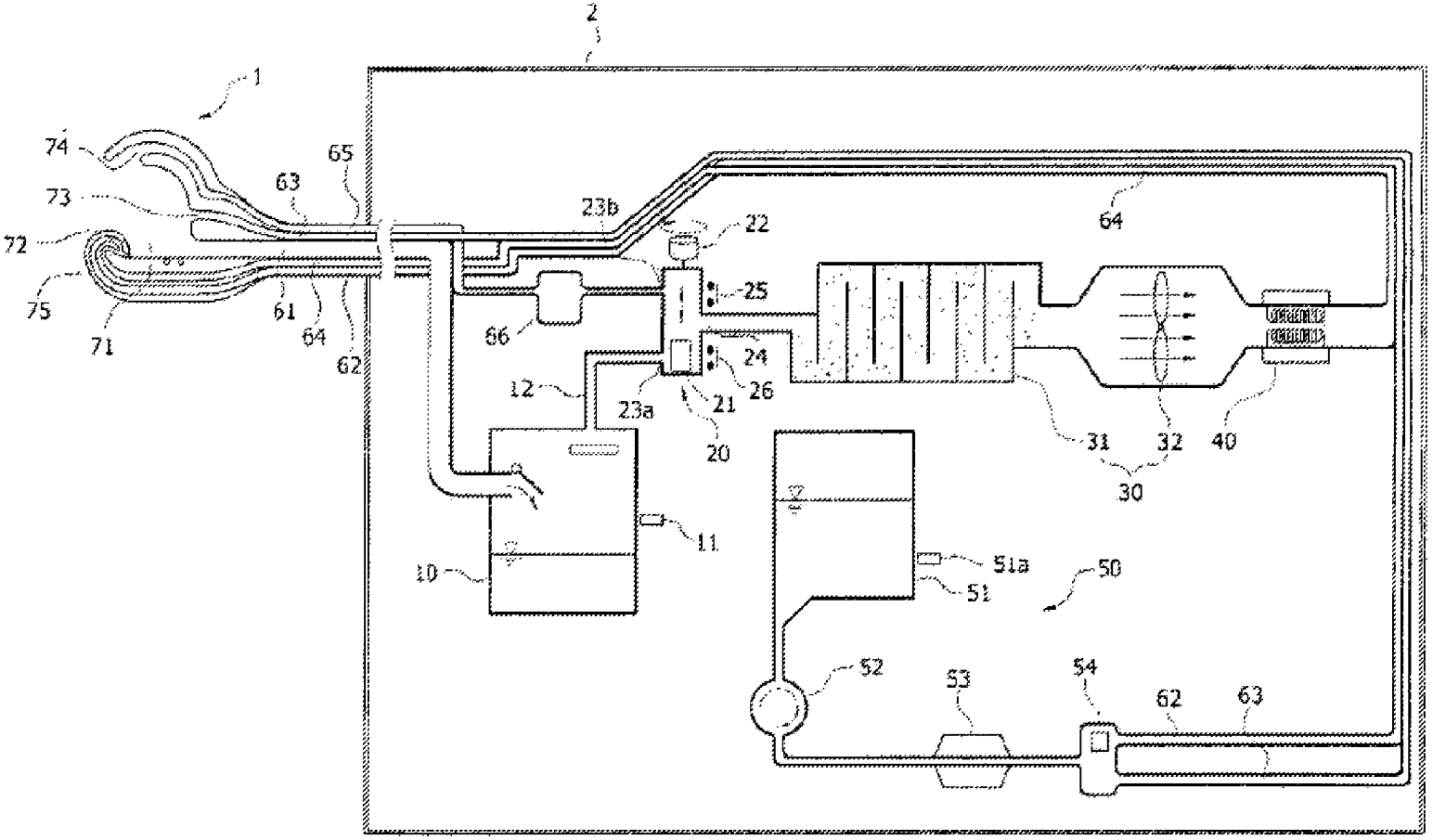
FIG. 2 is a view showing when the position of a valve unit of a flow channel switching unit is changed in the apparatus for treating excreta of FIG. 1.

FIG. 2 is a view showing when the position of a valve unit of a flow channel switching unit is changed in the apparatus for treating excreta of FIG. 1.

The position of the valve unit 21 of the flow channel switching unit 20 is changed from the second inlet 23*b* to the first inlet 23*a* by the motor 22. In this case, as the vacuum pump 32 is operated, air flows into the filter 31 through an air intake port 74 and an air intake line 65.

Figure 3:
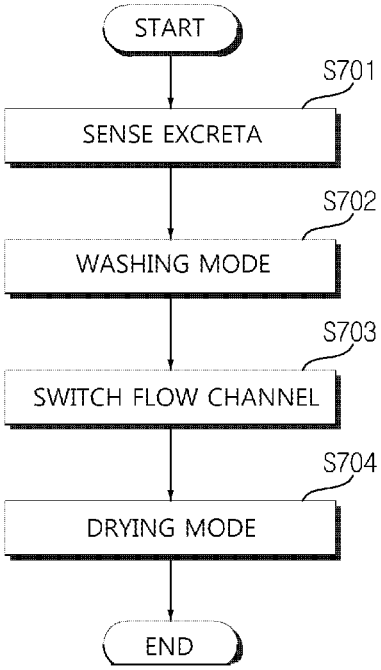
FIG. 3 is a flowchart showing a method of treating excreta according to the present invention.

FIG. 3 is a flowchart showing a method of treating excreta according to the present invention.

First, when a patient excretes, an excreta sensor (not shown) disposed at the excreta receiving portion 71 in the port 1 senses that it is excreta (S701). In this case, it is possible to discriminate between feces, urine, and gas by a combination of signals from the gas sensor 66.

When the excreta is sensed, a washing mode for washing the excreta and the patient's hip proceeds (S702). When the valve unit 21 of the flow channel switching unit 20 is positioned to block the first inlet 23*a* before the washing mode proceeds, the position of the valve unit 21 is changed into the state shown in FIG. 1 to open the first inlet 23*a* and close the second inlet 23*b*.

A vacuum suction force generated by the operation of the vacuum pump 32 in the excreta suctioning unit 30 is applied to the excreta receiving portion 71 through the excreta storage unit 10 and the excreta intake line 61, such that the excreta flows into the excreta storage unit 10 through the excreta intake line 61. Further, in the excreta receiving unit 71, wash water is sprayed through the wash water spray nozzle 72 by the operation of the wash water supply unit 50 while the air suctioned into the vacuum pump 32 is sprayed from the air spray nozzle 75 through the wash air supply line 64. As the air is sprayed through the air spray nozzle 75, the excreta can be easily suctioned into the excreta storage unit 10, as compared with when only wash water is sprayed. Further, the wash water is supplied through the bidet nozzle line 63 and then sprayed through the bidet nozzle 73 to wash the patient's anus and pelvic region.

The internal air circulation channel is switched by the flow channel switching unit 20 after the washing mode is finished (S703). That is, the position of the valve unit 21 is changed, such that the excreta storage unit 10 and the excreta suctioning unit 30 are disconnected while the air intake port 74 for suctioning the air in the port 1 and the excreta suctioning unit 30 are connected through the second inlet 23*b* of the flow channel switching unit 20.

Thereafter, as the excreta suctioning unit 30 is operated, a drying mode for drying the inside of the port 1 by suctioning air through the air intake port 74 in the port 1 and spraying the air, which sequentially passes through the air intake line 65, the second inlet 23*b* of the flow channel switching unit 20, the outlet 24, and the excreta suctioning unit 30, through the air spray nozzle 75 in the port 1, is performed (S704). In this case, since the air does not pass through the excreta storage unit 10, the circulating air does not smell, such that the air in the space where there is the patient is not contaminated. Further, since the air passing through the filter 31 is not contaminated, the life span of the filter 31 can be extended.

The above modes are repeated when excreta is sensed after the drying mode is finished.

Embodiment 2

An automatic excreta treatment apparatus according to Embodiment 2 of the present invention, as shown in FIG. 1, includes a port 1 receiving excreta from a patient and a control device unit 2 connected with the port 1 and controlling storage of excreta after suctioning the excreta from the port 1 or supply of wash water to the port 1.

The control device unit 2 includes an excreta storage unit 10 that is connected with the port 1 and stores the excreta, an excreta suctioning unit 30 that is connected to the excreta storage unit 10 and vacuum-suctions the excreta in the port 1, a flow channel switching unit 20 that switches an air circulation channel when washing excreta or drying the port 1, and a wash water supply unit 50 that supplies wash water to wash excreta and a bidet. Non-described reference numeral '40' indicates a heater.

An excreta receiving portion 71 where excreta of a patient is collected, a wash water spray nozzle 72 that sprays air or a mixture of air and wash water to the excreta receiving portion 71, a bidet nozzle 73 that sprays wash water to the patient's anus and vulva, and an air intake port 74 that suctions the air in the port 1 are formed in the port 1.

The excreta receiving portion 71 is connected with an excreta intake line 61 connected to the excreta storage unit 10.

The nozzles in the port 1 are connected with flow channels for air and wash water.

First, the wash water spray nozzle 72 is connected with a wash air supply line 64, which is connected with the outlet side of the excreta suctioning unit 30, and the wash water supply line 62 that is connected with the wash water supply unit 50. Therefore, air and wash water are mixed and then supplied to the wash water spray nozzle 72.

The air intake port 74 is connected to an air intake line 65 connected with the inlet side of the excreta suctioning unit 30.

Further, the bidet nozzle 73 is connected with a bidet nozzle line 63 connected to the water wash supply unit 50.

Excreta suctioned by the suction force of the excreta suctioning unit 30 flows into the excreta storage unit 10 through the excreta intake line 61. The inside of the excreta storage unit 10 and the flow channel switching unit 20 are connected by a connection pipe.

The flow channel switching unit 20 includes a valve unit 21 that selectively opens and closes two inlets 23*a* and 23*b* and a motor 22 that reciprocates straight the valve unit 21. An outlet 24 is formed opposite the inlets 23*a* and 23*b* and allows the air suctioned from the port 1 to be supplied to the excreta suctioning unit 30 through any one of the two inlets 23*a* and 23*b*.

The excreta suctioning unit 30 includes a filter 31 connected with the outlet 24 of the flow channel switching unit 20 to purify air and a vacuum pump 32 connected to the outlet side of the filter 31. The air discharged from the vacuum pump 32 is heated by a heater 40.

The wash water supply unit 50 includes a wash water storage tank 51 storing wash water, a pump 52 supplying the wash water in the wash water storage tank 51 to the port 1, a heater 53 heating the wash water to be warm, and a valve 54 selectively supplying the wash water to any one of the wash water supply line 62 and the bidet nozzle line 63.

The portion A in FIG. 1 indicates the portion where the excreta intake line 61, the wash water supply line 62, the bidet nozzle line 63, and the wash air supply line 64 are connected to the control device unit 2, which is a main body, and the structure of the portion A is described in detail below.

Figure 4:
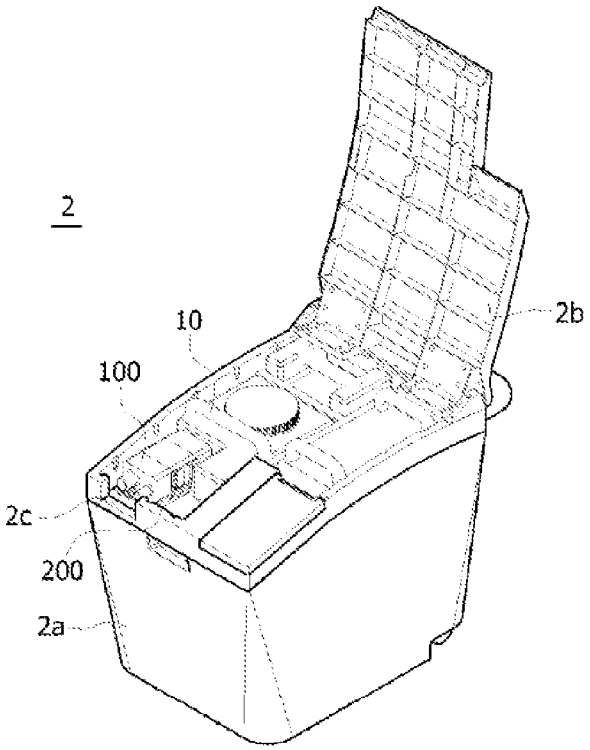
FIG. 4 is a perspective view showing a control device unit that is a main body in an automatic excreta treatment apparatus according to the present invention.

FIG. 4 is a perspective view showing the control device unit that is a main body in an automatic excreta treatment apparatus according to the present invention.

The control device unit 2 includes a case 2*a* accommodating components including the excreta storage unit 10 and a cover 2*b* covering the case 2*a* from above. A groove 2*c* is formed at one side of the upper end of the case 2*a* such that the excreta intake line 61, the wash water supply line 62, the bidet nozzle line 63, and the wash air supply line 64 pass through the groove 2*c*.

A plurality of tubes for the excreta intake line 61, the wash water supply line 62, the bidet nozzle line 63, and the wash air supply line 64 is disposed inside the groove 2*c* and a flow channel connection member 100 in which flow channels for wash water, air, and excreta are formed is disposed.

A base 200, which supports the flow channel connection member 100 to be slidable is disposed under the flow channel connection member 100 and the excreta storage unit 10 receiving excreta is disposed at the adjacent side of the flow channel connection member 100.

Figure 5:
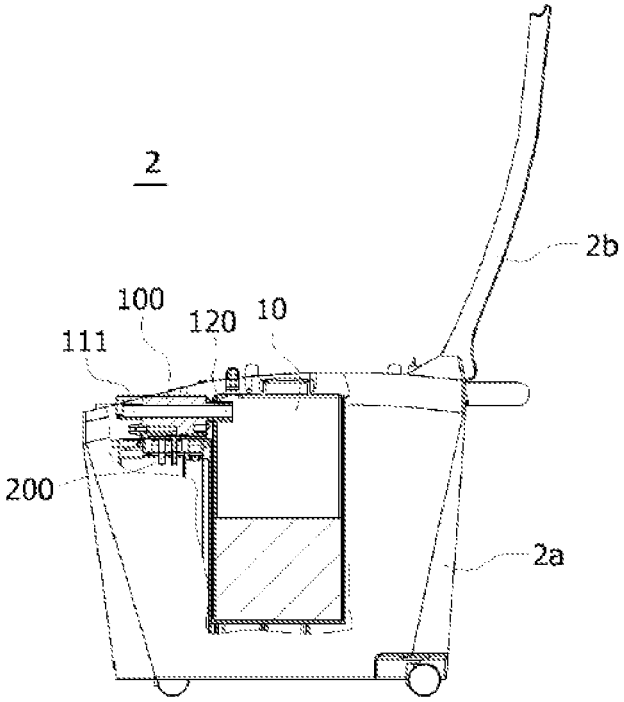
FIG. 5 is a cross-sectional view of a portion of the control device unit of the automatic excreta treatment apparatus according to the present invention.

FIG. 5 is a cross-sectional view of a portion of the control device unit of the automatic excreta treatment apparatus according to an exemplary embodiment of the present invention.

The flow channel connection member 100 is disposed above the base 200 and an excreta flow channel connector 120 is inserted to be connected in the excreta storage unit 10. Therefore, the excreta suctioned from the port 1 flows into the excreta storage unit 10 through the excreta intake line 61, an inlet 111, and the excreta flow channel connector 120.

Figure 6:
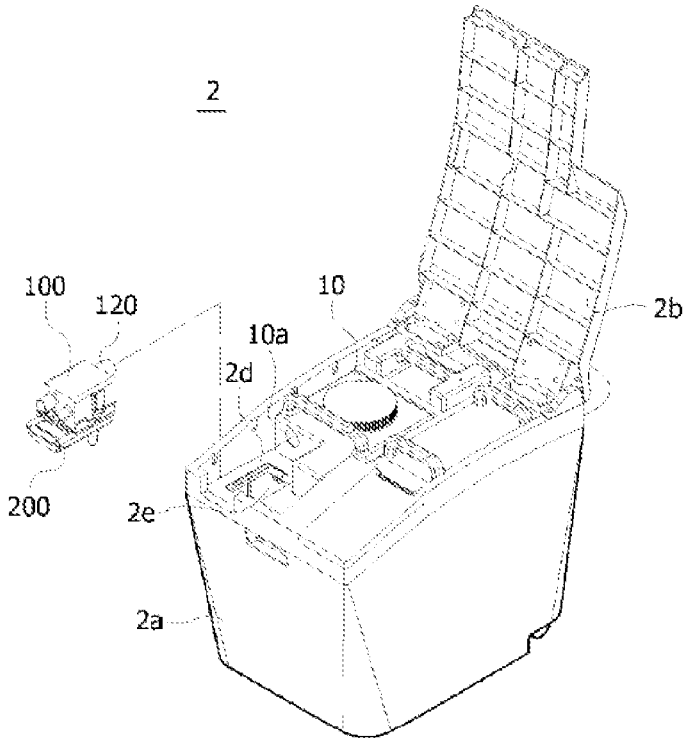
FIG. 6 is a perspective view showing when a flow channel connection member and a base are separated in the automatic excreta treatment apparatus according to the present invention.

FIG. 6 is a perspective view showing when a flow channel connection member and a base are separated in the automatic excreta treatment apparatus according to the present invention.

The flow channel connection member 100 and the base 200 are disposed at one side of the upper end inside the case 2*a* of the control device unit 2. A bottom plate 2*d* where the base 200 is mounted is formed in a flat plate shape inside the case 2*a* of the control device unit 2 and a hole 2*e* is formed in the bottom plate 2*d* such that the base 200 is inserted. The base 200 can slide forward/backward on the edge of the hole 2*e*.

Meanwhile, an insertion hole 10*a* that is an excreta flow channel connection portion is formed through the front of the excreta storage unit 10 such that the excreta flow channel connector 120 of the flow channel connection member 100 is inserted. The excreta flow channel connector 120 is made of an elastic member and tapered and airtightness is achieved only by inserting the excreta flow channel connector 120 in the insertion hole 10*a*.

Figure 9:
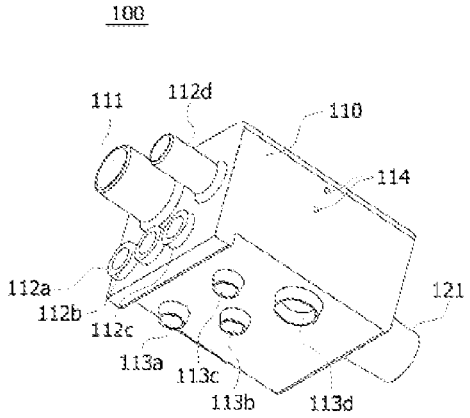
FIG. 9 is a perspective view showing the flow channel connection member shown in FIG. 7, seen from another angle.

FIG. 7 is a perspective view showing when the flow channel connection member and the base according to the present invention are combined by a coupling member, FIG. 8 is an exploded perspective view showing when the components are dissembled from the state of FIG. 7, and FIG. 9 is a perspective view showing the flow channel connection member shown in FIG. 7, seen from another angle.

The flow channel connection member 100 has a box-shaped body 110 in which a plurality of flow channels through which excreta, wash water, and air pass is formed.

An excreta inlet port 111 connected with the excreta intake line 61 and wash water and air connection ports 112*a*, 112*b*, 112*c*, and 112*d*, which are connected to the wash water supply line 62, the bidet nozzle line 63, the wash air supply line 64, and the air intake line 65, respectively, protruded from the front of the body 110 of the flow channel connection member 100.

An excreta outlet port 121 through which the excreta flowing inside through the excreta inlet port 111 is discharged protrudes from the rear of the body 110 of the flow channel connection member 100 and a hermetic member 122 is in close contact with the outer circumference of the excreta outlet port 121, such that the excreta flow channel connector 120 is formed.

The excreta outlet port 121 and the hermetic member 122 are tapered with the same angle and the hermetic member 122 is made of an elastic material (for example, rubber), such that airtightness is achieved only by inserting the hermetic member in an insertion hole 10*a* of the excreta storage unit 10 and a smell is prevented from leaking out of the excreta storage unit 10.

Protrusions 113*a*, 113*b*, 113*c*, and 113*d* that are tapered to form the flow channels for air and wash water are formed on the bottom of the body 110 of the flow channel connection member 100. The wash water or the air that flows in/out through the wash water and air connection ports 112*a*, 112*b*, 112*c*, and 112*d* flows in/out through the protrusions 113*a*, 113*b*, 113*c*, and 113*d*.

A plurality of fastening holes 114 is formed through a side of the body 110 of the flow channel connection member 100 and the connection member 130 is fastened by the fastening holes 114. The connection member 130 is composed of a body 131, a locking hook 132 connected to the body 131 to be rotatable about a hinge shaft, and a fastening member 133 fastening the body 131 and the locking hook 132 in the fastening hole 114.

The base 200 is composed of a tube connection member 210 being in close contact with the bottom of the flow channel connection member 100, a support bracket 220 supporting the flow channel connection member 100 and the tube connection member 210, under the tube connection member 210, a plurality of supporters 230 supporting the bottom of the support bracket 220, and a sliding member 240 sliding in the hole 2*e* of the bottom plate 2*d*, with the bottom of the support 230 fixed thereto.

The tube connection member 210 is composed of a flat plate-shaped body 211, a plurality of protrusions 212*a*, 212*b*, 212*c*, and 212*d* tapered on the upper surface of the body 211, and a plurality of tube connection portions 213*a*, 213*b*, 213*c*, and 213*d* protruding at a predetermined length from the bottom of the body 211, corresponding to the protrusions 212*a*, 212*b*, 212*c*, and 212*d*.

A connection port 250 is fitted in the tube connection portions 213*a*, 213*b*, 213*c*, and 213*d*. A tube (not shown) is connected to the other side of the connection port 250.

When the flow channel connection member 100 is coupled to the upper surface of the tube connection member 210, the protrusions 113*a*, 113*b*, 113*c*, and 113*d* on the bottom of the flow channel connection member 100 overlap and press, in close contact with, the protrusions 212*a*, 212*b*, 212*c*, and 212*d* of the tube connection member 210 at a predetermine thickness, such that the flow channels for air and wash water are connected.

Further, the tube connection member 210 is made of an elastic material (for example, rubber), such that airtightness is achieved by the close-contact structure, thereby preventing leakage of air and wash water.

The support bracket 220 is composed of a flat plate-shaped body 221, flanges 222, 223, 224, and 225 bending and extending upward from the edge of the body 221, a plurality of through-holes 226 where the tube connection portions 213 are inserted, and a plurality of supporter hole 227 smaller than the through-holes 226.

The supporters 230 have protruding upper ends to be inserted in the supporter holes 227 of the support bracket 220 and bottoms fixed to the bottom body 241 of the sliding member 240. The supporters 230 support the flow channel connection member 110, the tube connection member 210, and the support bracket 220, by the structure.

The sliding member 240 has the bottom body 241 where the bottoms of the supporters 230 are fixed, through-holes 242 where the tube connection portions 213 of the tube connection member 210 are inserted, corresponding to the through-holes 226 of the support bracket 220, and a sliding portion 243 formed at both ends of the bottom body 241 and sliding forward/backward.

Further, locking fixing plates 244 protrude forward from both left and right sides of the body of the sliding member 240 and a plurality of cylindrical bosses 245 protrudes downward from the fixing plates 244.

The locking portion 300 is composed of a locking member 310 that is restricted in forward movement when the flow channel connection member 100 and the base 200 slide rearward to the excreta storage unit 10, a spring 320 elastically support upward the locking member 310, a spring support member 330 supporting the lower end of the spring 320, and a hinge shaft 340 inserted in the pivot center 321 of the locking member 310.

A wedge-shaped locking step 311 with a right-angled front is formed at the upper portion of the front of the locking member 310, such that as the locking step 311 is pivoted upward about the pivot center 312 at the rear end by the force of the spring 320, it is locked to the front edge of the hole 2*e* of the bottom plate 2*d* and the flow channel connection member 100 and the base 210 are prevented from moving forward.

The spring support member 330 has four fastening holes 331 at both ends to be coupled to the bosses 245 of the sliding member 240 and coupled to the bosses 245 by the fastening member 350.

Further, a spring seat 332 is recessed at the center of the spring support member 330 to fix the spring 320, such that the spring 320 is inserted and fixed therein.

Meanwhile, the hinge shaft 340 is inserted into a hinge shaft insertion hole 333 and the pivot center 321 of the locking member 310.

Figure 10:
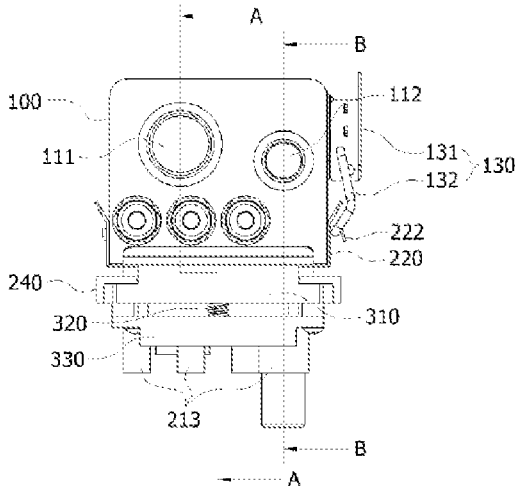
FIG. 10 is a view showing the front when the flow channel connection member and the base according to the present invention are combined.
Figure 11:
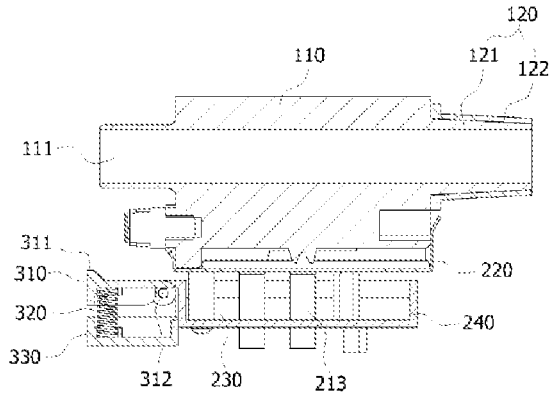
FIG. 11 is a cross-sectional view taken along the line A-A of FIG. 10.
Figure 12:
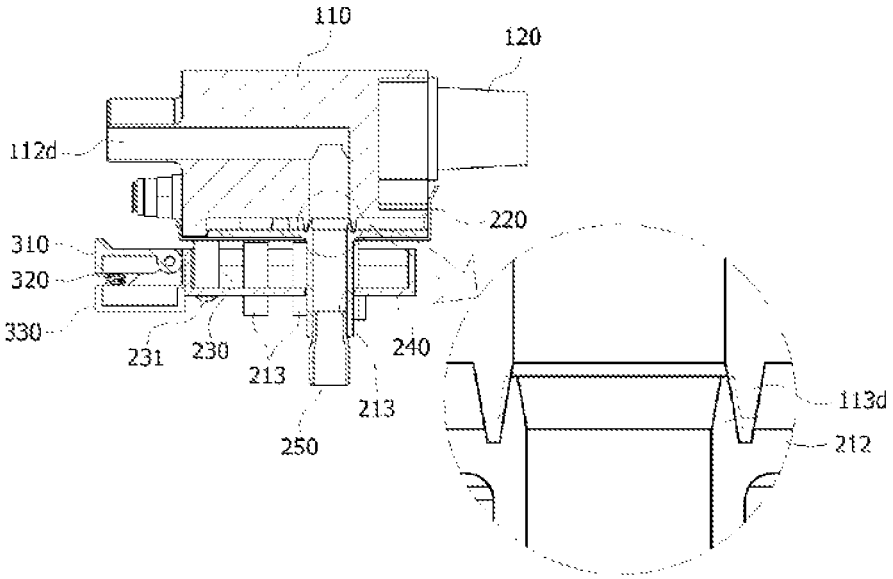
FIG. 12 is a cross-sectional view taken along the line B-B of FIG. 10.

FIG. 10 is a view showing the front when the flow channel connection member and the base according to the present invention are combined, FIG. 11 is a cross-sectional view taken along the line A-A of FIG. 10, and FIG. 12 is a cross-sectional view taken along the line B-B of FIG. 10.

Referring to FIG. 11, the hermetic member 122 covers, in close contact with, the outer circumference of the excreta outlet port 121, on the rear of the body 110 of the flow channel connection member 100. The spring 320 is disposed on the spring support member 330 and the locking member 310 is elastically supported on the upper end of the spring 320. The supporter 230 is coupled with the sliding member 240 by the fastening member 231 and supports the portion between the sliding member 240 and the support bracket 220.

Referring to FIG. 12, the protrusion 113*d* formed on the bottom of the body 110 of the flow channel connection member 100 overlaps and presses, in contact with, the protrusion 212*d* of the tube connection member 210 at a predetermined thickness. Since the tube connection member 210 is made of an elastic member, air or wash water are prevented from leaking at the close-contact portion. Therefore, the hermetic structure can be achieved by a simple structure.

Figure 13:
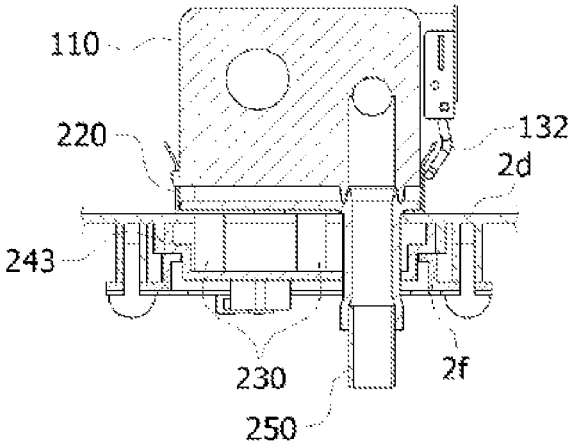
FIG. 13 is a view showing a transverse cross-section when the flow channel connection member and the base according to the present invention are combined.

FIG. 13 is a view showing a transverse cross-section when the flow channel connection member and the base according to the present invention are combined.

The sliding portion 243 formed at both sides of the sliding member 240 is guided to slide by the bottom plate 2*d* inside the case 2*a* and a slide rail 2*f* bending at 90 degrees under the bottom plate 2*d*.

Figure 14:
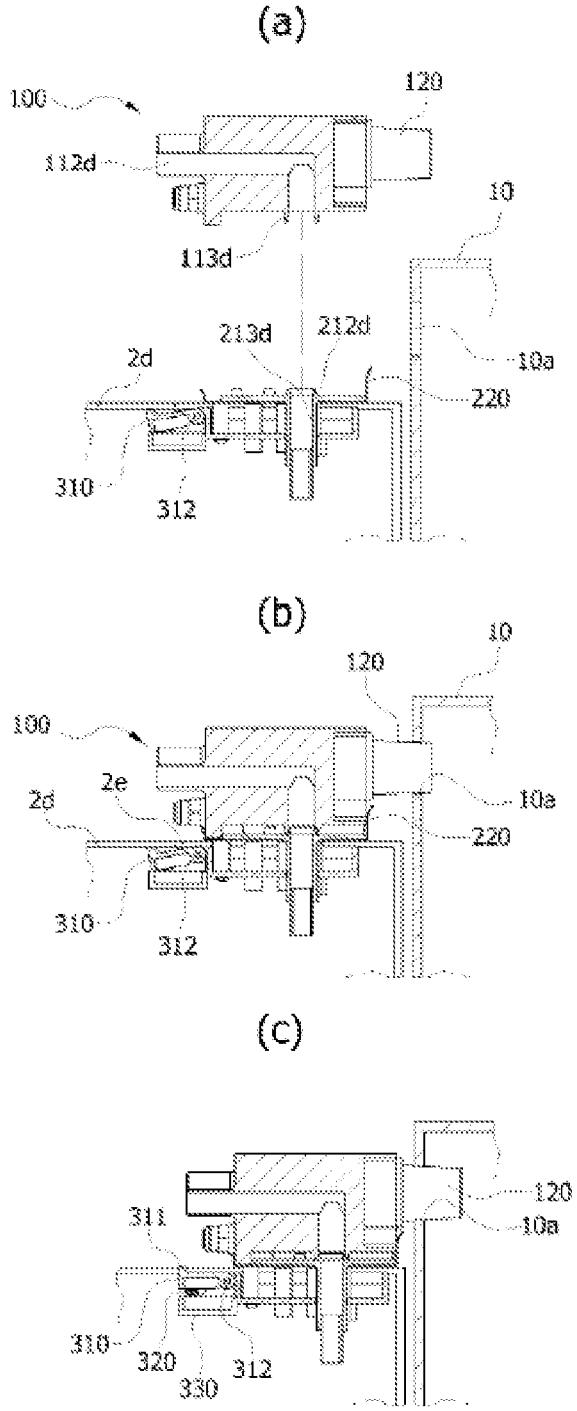
FIG. 14 is an operational view showing a process of disposing the flow channel connection member according to the present invention into a case.

FIG. 14 is an operational view showing a process of disposing the flow channel connection member according to the present invention into the case.

Referring to FIG. 14A, the flow channel connection member 100 is separated from the base 200 and the excreta storage unit 10 and the base 200 is fixed to the bottom plate 2*d*.

In this state, as shown in FIG. 14B, the flow channel connection member 100 is seated on the tube connection member 210 inside the support bracket 220 of the base 200. In this process, the excreta flow channel connector 120 is inserted into the insertion hole 10*a* of the excreta storage unit 10.

Thereafter, the flow channel connection member 100 and the base 200 are integrally coupled by locking the locking hook 132 of the coupling member 130 to an n-shaped locking hook connector 222*a* of the support bracket 220.

In this state, as shown in FIG. 14C, when the flow channel connection member 100 and the base 200 are pushed to the excreta storage unit 10, the flow channel connection member 100 and the base 200 integrally move rearward on the slide rail 2*f*. In this configuration, the excreta flow channel connector 120 is hermetically press-fitted into the insertion hole 10*a* of the excreta storage unit 10 by the hermetic member 122 made of an elastic material. Further, the locking member 310 is protruded upward by the spring 320 and the locking step 311 is locked to the front edge of the hole 2*e* of the bottom plate 2*d*, such that the flow channel connection member 100 and the base 200 are prevented from being pushed forward.

As described above, since it is possible to couple the flow channel connection member 100 to the control device unit 2 only by sliding and inserting the flow channel connection member 100, the assembly becomes easy. Further, the number of joints in the flow channels through which excreta, air, and wash water flow decreases, such that leakage thereof is prevented.

When the excreta storage unit 10 is fully filled with excreta from a patient after the flow channel connection member 100 is coupled to the base 200 and the excreta storage unit 10, it is necessary to separate the flow channel connection member 100 in order to separate the excreta storage unit 10 from the control device unit 2.

For this configuration, it is necessary to press down the locking step 311 in order to release the locking step 311 of the locking member 310, which is locked to the bottom plate 2*d*. In this process, the locking step 311 pivots downward against the elastic force of the spring 320.

Thereafter, it is possible to separate the flow channel connection member 100 by performing the operations in the reverse order of that described above. The parts are easily separated by those processes, such that it is easy to replace the parts.

Embodiment 3

An automatic excreta treatment apparatus according to Embodiment 3 of the present invention, as shown in FIG. 1, includes a port 1 receiving excreta from a patient and a control device unit 2 connected with the port 1 and controlling storage of excreta after suctioning the excreta from the port 1 or supply of wash water to the port 1.

The control device unit 2 includes an excreta storage unit 10 that is connected with the port 1 and stores the excreta, an excreta suctioning unit 40 that is connected to the excreta storage unit 10 and vacuum-suctions the excreta in the port 1, a flow channel switching unit 20 that switches an air circulation channel when washing excreta or drying the port 1, and a wash water supply unit 50 that supplies wash water to wash excreta and a bidet.

An excreta receiving portion 71 where excreta of a patient is collected, a wash water spray nozzle 72 that sprays air or a mixture of air and wash water to the excreta receiving portion 71, a bidet nozzle 73 that sprays wash water to the patient's anus and pelvic region, and an air intake port 74 that suctions the air in the port 1 are formed in the port 1.

The excreta receiving portion 71 is connected with an excreta intake line 61 connected to the excreta storage unit 10.

The nozzles in the port 1 are connected with flow channels for air and wash water.

First, the wash water spray nozzle 72 is connected with a wash air supply line 64, which is connected with the outlet side of the excreta suctioning unit 30, and the wash water supply line 62 that is connected with the wash water supply unit 50. Therefore, air and wash water are mixed and then supplied to the wash water spray nozzle 72.

The air intake port 74 is connected to an air intake line 65 connected with the inlet side of the excreta suctioning unit 30.

Further, the bidet nozzle 73 is connected with a bidet nozzle line 63 connected to the water wash supply unit 50.

Excreta suctioned by the suction force of the excreta suctioning unit 30 flows into the excreta storage unit 10 through the excreta intake line 61. The inside of the excreta storage unit 10 and the flow channel switching unit 20 are connected by a connection pipe.

The flow channel switching unit 20 includes a valve unit 21 that selectively opens and closes two inlets 23*a* and 23*b* and a motor 22 that reciprocates straight the valve unit 21. An outlet 24 is formed opposite the inlets 23*a* and 23*b* and allows the air suctioned from the port 1 to be supplied to the excreta suctioning unit 30 through any one of the two inlets 23*a* and 23*b*.

The excreta suctioning unit 30 includes a filter 31 connected with the outlet 24 of the flow channel switching unit 20 to purify air and a vacuum pump 32 connected to the outlet side of the filter 31. The air discharged from the vacuum pump 32 is heated by a heater 40.

The wash water supply unit 50 includes a wash water storage tank 51 storing wash water, a pump 52 supplying the wash water in the wash water storage tank 51 to the port 1, a heater 53 heating the wash water to be warm, and a valve 54 selectively supplying the wash water to any one of the wash water supply line 62 and the bidet nozzle line 63.

Figure 15:
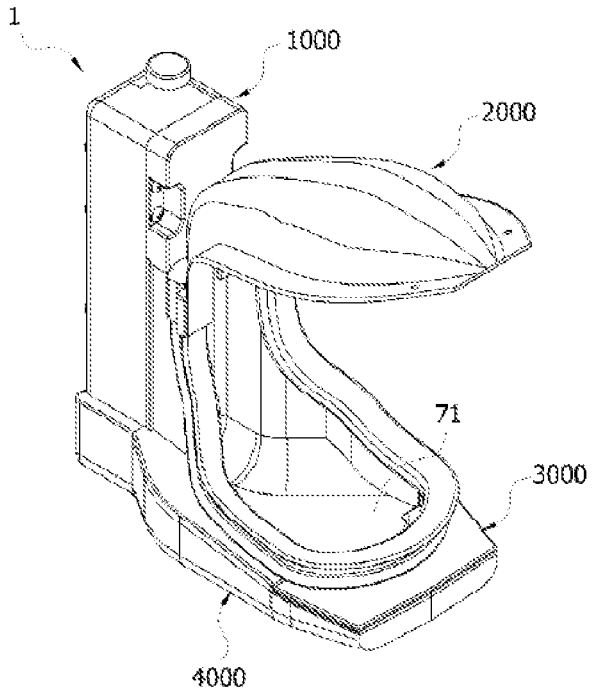
FIG. 15 is a perspective view showing a port according to an exemplary embodiment of the present invention.
Figure 16:
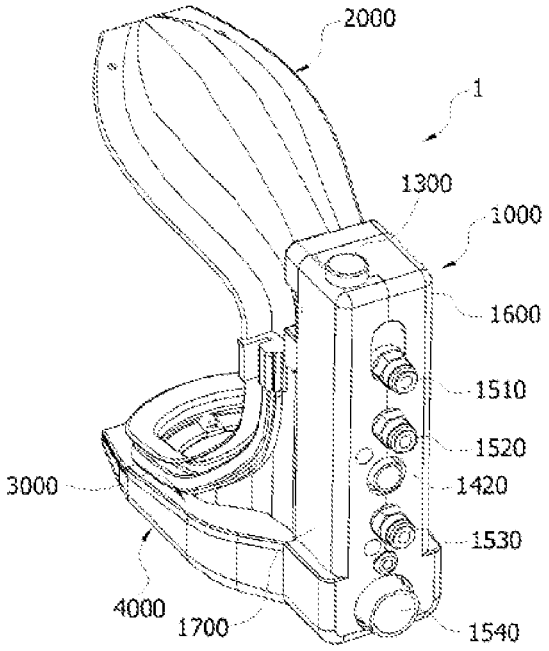
FIG. 16 is a perspective view showing the port according to the present invention, seen from another angle.

FIG. 15 is a perspective view showing the port according to the present invention and FIG. 16 is a perspective view showing the port according to the present invention, seen from another angle.

The port 1 is composed of a flow channel connector 1000 connected to a plurality of tubes 61, 62, 63, 64, and 65 and providing flow channels for wash water or air, a mounting member 2000 disposed ahead of the flow channel connector 1000 to come in close contact with the patient's hip, an excreta receiving main body 3000 coupled to the lower portion of the mounting member 2000 and having the excreta receiving portion 71 to receive excreta from a patient, and a lower cover 4000 coupled to the lower portion of an excreta receiving main body 3000.

The mounting member 2000 is formed in a diaper shape to retain the body of a patient (for example, the hip or the pelvic region). The portion that is brought in contact with the skin is made of an elastic material for close contact with the skin.

The excreta receiving main body 3000 is equipped with a sensor that senses whether there is excreta in the excreta receiving portion 71 and the wash water spray nozzle 72 that washes excreta in the excreta receiving portion 71 (see FIG. 1).

Referring to FIG. 16, the flow channel connector 1000 is sequentially equipped with a first connection port 1510 connected with the bidet nozzle line 63, a second connection port 1520 connected with the air intake line 61, a wash air connector 1420 connected with the wash air supply line 64, a third connection port 1530 connected with the wash water supply line 62, and an excreta intake port 1540 connected with the excreta intake line 61, from the upper portion to the lower portion.

The outer side of the flow channel connector 100 is covered with a first cover member 1600 and a second cover member 1700. The first cover member 1600 and the second cover member 1700 are jointed substantially symmetrical to be separable at the left and right and a height control member 1300 for controlling the vertical height of the bidet nozzle unit 1100, which is described below, on the first and second cover members.

Figure 17:
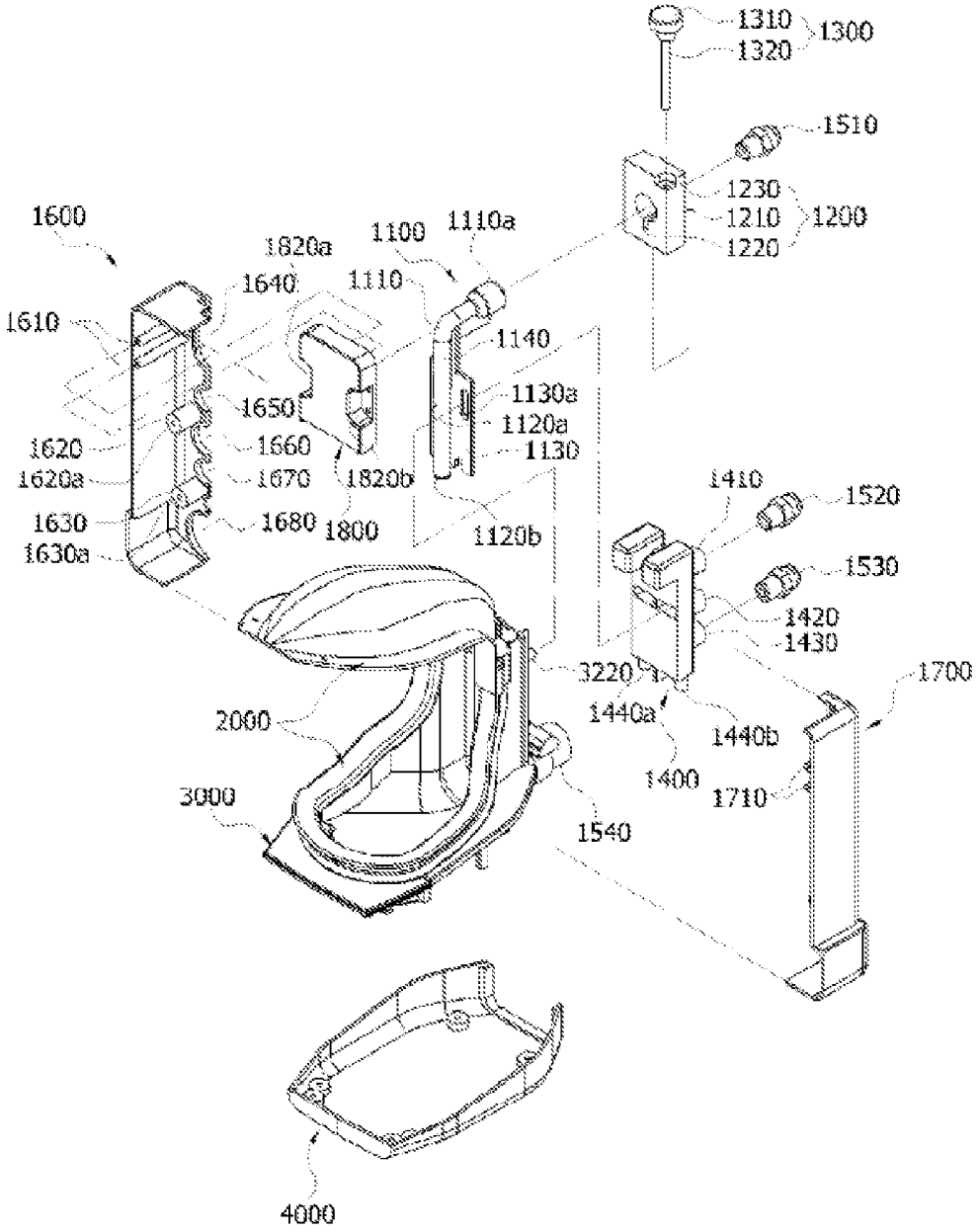
FIG. 17 is an exploded perspective view of the port according to the present invention.
Figure 18:
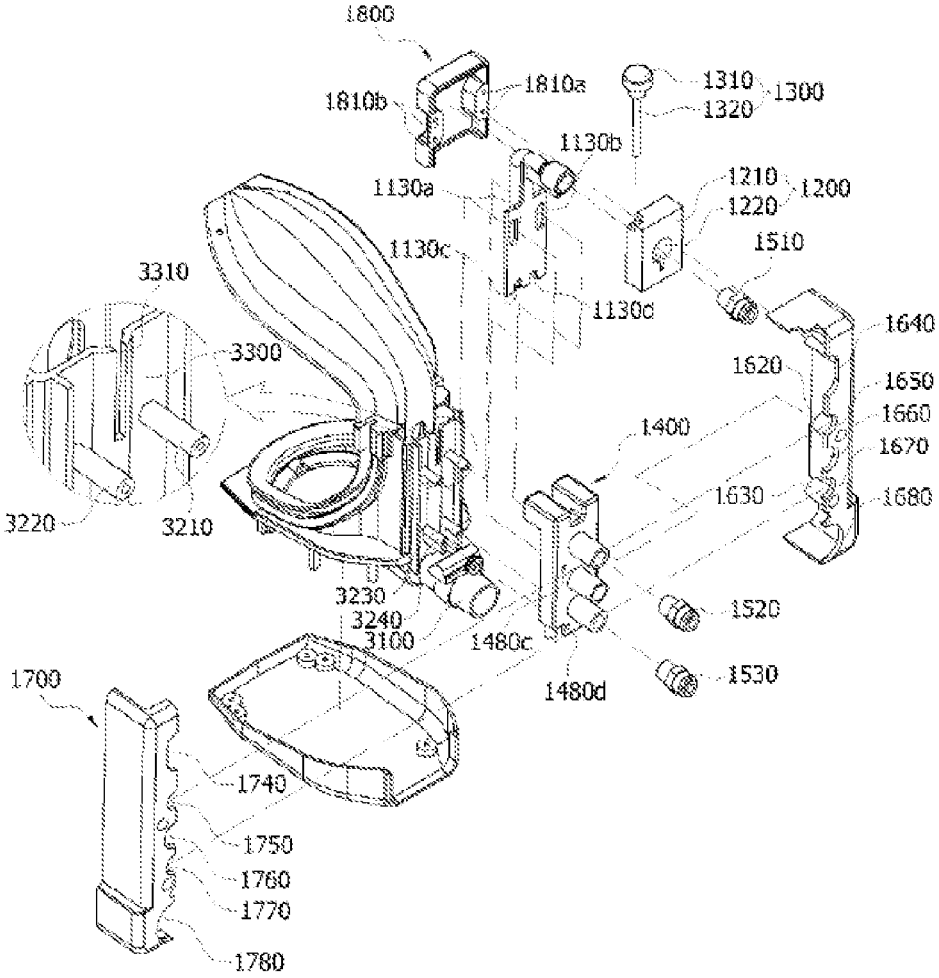
FIG. 18 is an exploded perspective view showing the port according to the present invention, seen from another angle.

FIG. 17 is an exploded perspective view showing the port according to the present invention and FIG. 18 is an exploded perspective view showing the port according to the present invention, seen from another angle.

The flow channel connector 1000 includes the bidet nozzle unit 1100 spraying the wash water supplied through the bidet nozzle line 63, a nozzle pipe coupling member 1200 coupled to vertically move with the bidet nozzle unit 1100, the height control member 1300 vertically moving the bidet nozzle unit 1100 and the nozzle pipe coupling member 1200, a flow channel forming member 1400 having flow channels for air and wash water therein, and the first cover member 1600, the second cover member 1700, and a third cover member 1800 covering the bidet nozzle unit 1100, the nozzle pipe coupling member 1200, the height control member 1300, and the flow channel forming member 1400.

The bidet nozzle unit 1100 is composed of a bidet nozzle pipe 1110 having two or more nozzle holes 1120*a* and 1120*b*, which are vertically formed, and bending at 90 degrees, connectors 1110*a* formed at the upper end of the bidet nozzle pipe 1110, and a support plate 1130 integrally formed with the bidet nozzle pipe 1110.

The lower end of the bidet nozzle pipe 1110 is blocked, such that the wash water flowing inside through the connector 1110*a* is sprayed toward the patient's hip through the nozzle holes 1120*a* and 1120*b*. The two nozzle holes 1120*a* and 1120*b* are provided for washing the pelvic region and the anus of women. The nozzle holes 1120*a* and 1120*b* correspond to the bidet nozzle 73 shown in FIG. 1.

The support plate 1130 is integrally formed with the bidet nozzle pipe 1110, at a predetermined distance from the bidet nozzle pipe 1110. An insertion portion 1140 that is inserted in a groove 3310 (see FIG. 18) of a vertical plate 3300 is connected between the support plate 1130 and the bidet nozzle pipe 1110.

Further, two oblong holes 1130*a* and 1130*b* that are vertically longer than the width are formed at the left and right in the support plate 1130. Protrusions 3210 and 3220 of the vertical plate 3300 are inserted in the oblong holes 1130*a* and 1130*b*. The ends of the protrusions 3210 and 3220 are inserted in the groove 1490 of the flow channel forming member 1400 and fixed in a fastening hole 1480*c* and a fastening hole (not shown) formed opposite the fastening hole 1480*c* by a fastening member 1810 (see FIG. 22).

Figure 22:
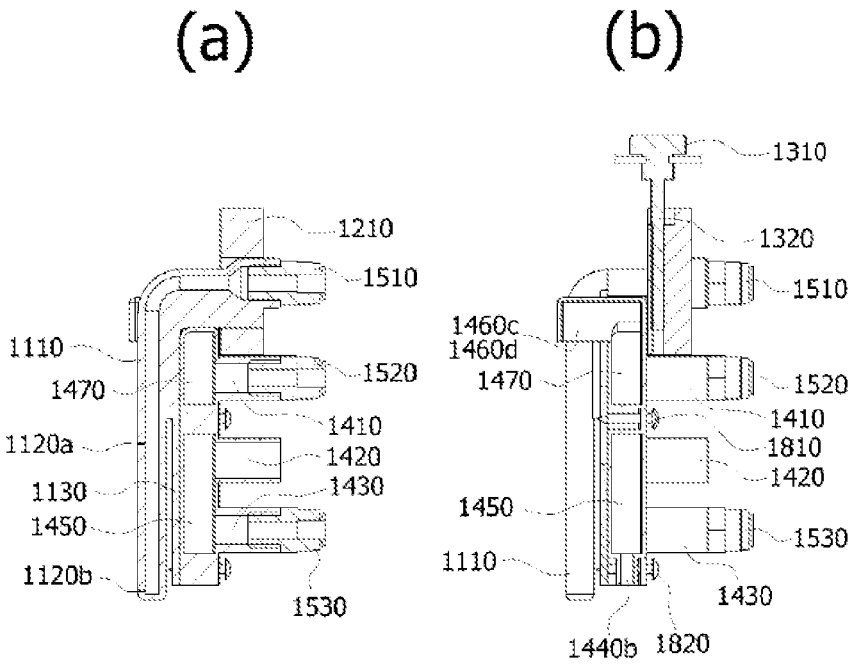
FIG. 22 is a cross-sectional view taken along the lines A-A and B-B of FIG. 21.

Semicircular grooves 1130*c* and 1130*d* are formed on the lower end of the support plate 1130, the protrusions 3230 and 3240 protruding from the lower portion of the vertical plate 3300 are inserted in the grooves 1130*c* and 1130*d*, and the ends of the protrusions 3230 and 3240 are fixed in a fastening hole 1480 of the flow channel forming member 1400 and a fastening hole (not shown) formed opposite the fastening hole 1480*d* by a fastening member 1820 (see FIG. 22).

In the nozzle pipe coupling member 1200, a nozzle pipe insertion hole 1220 is formed through a body 1210 such that the connector 1110*a* of the bidet nozzle pipe 1110 is inserted, and a thread insertion hole 1230, where a threaded portion 1320 of the height control member 1300 is inserted, is formed at a vertically predetermined height, at an edge of the upper surface. Therefore, it is possible to decrease the size of the nozzle pipe coupling member 1200 and increase the vertical stroke of the bidet nozzle unit 1100. The thread insertion hole 1230 is threaded on the inner surface.

When a grip 1310 of the height control member 1300 is turned, with the threaded portion 1320 of the height control member 1300 inserted in the thread insertion hole 1230, the nozzle pipe coupling member 1200 and the bidet nozzle unit 1110 integrally and vertically move. Therefore, it is possible to control the vertical position of the nozzle holes 1120*a* and 1120*b*, depending on the bodily structure of a patient.

A first connection port 1510 is coupled to the connector 1110*a* of the bidet nozzle pipe 1110 such that the bidet nozzle line 63 shown in FIG. 1 is connected.

The flow channel forming member 1400 has flow channels for air and wash water therein.

The flow channel forming member 1400 has a pair of upper bodies 1460*a* and 1460*b* having openings 1460*c* and 1460*d* to suction air, a mixing space 1470 where the air suctioned through the openings 1460*c* and 1460*d* is mixed, and an intake air connector 1410 connected to the air intake line 65 to discharge the air in the mixing space 1470 to the air intake line 65.

The intake air connector 1410 is connected with the air intake line 65 shown in FIG. 1. Therefore, the air suctioned by vacuum suction of the control device unit 2 is suctioned into the air intake line 65 through the openings 1460*c* and 1460*d*, the mixing space 1470, and the intake air connector 1410.

Meanwhile, the pair of upper bodies 1460*a* and 1460*b* is spaced apart from each other at a predetermined distance such that the bidet nozzle pipe 1110 passes through between the upper bodies.

Further, the wash air connector 1420 connected with the wash air supply line 64 to supply air from the control device unit 2 is formed under the intake air connector 1410 and a wash water connector 1430 connected with the wash water supply line 62 to supply wash water from the control device unit 2 is formed under the wash air connector 1420.

The air supplied through the wash air connector 1420 and the wash water supplied through the wash water connector 1430 are mixed in the mixing space 1450 and the air and wash water mixed in the mixing space 1450 washes excreta by being sprayed to the excreta receiving portion 71 through the wash water spray nozzle 72 shown in FIG. 1 while being discharged through a pair of dischargers 1440*a* and 1440*b* formed under the mixing space.

The flow channel connector 1000 includes the first cover member 1600, the second cover member 1700 joined opposite the first cover member 1600, and the third cover member 1800 coupled to the first and second cover members 1600 and 1700.

The bidet nozzle unit 1100, the nozzle pipe coupling member 1200, and the flow channel forming member 1300 are positioned in the space defined by the first cover member 1600, the second cover member 1700, and the third cover member 1800.

A fastening hole 1610 of the first cover member 1600 and a fastening hole 1810*a* formed at the recession 1820*a* of the third fastening member 1800 are connected by a fastening member (not shown).

A fastening hole 1710 of the second cover member 1700 and a fastening hole 1810*b* formed at the recession 1820*b* of the third fastening member 1800 are connected by a fastening member (not shown).

Bosses 1620 and 1630 with fastening holes 1620*a* and 1630*a* protrude inside the first cover member 1600, and the fastening holes 1620*a* and 1630*a*, the fastening hole (not shown) of the flow channel forming member 1400, and protrusion 3210 and 3230 of the vertical plate 3300 are connected by fastening members.

A Boss 1720 (see FIG. 19) having the same shape and function as the first cover member 1600 is also formed inside the second cover member 1700.

Substantially semicircular grooves 1640, 1650, 1660, 1670, and 1680 are formed at the first cover member 1600 and grooves 1740, 1750, 1760, 1770, and 1780 having the same shapes are also symmetrically formed at the second cover member 1700, such that when the first cover member 1600 and the second cover member 1700 are joined, the first to third connection ports 1510, 1520, and 1530, the wash air connector 1420, and the excreta intake port 1540 pass through the potions defined by the grooves 1640, 1650, 1660, 1670, 1680, 1740, 1750, 1760, 1770, and 1780.

Meanwhile, the upper edge of the first cover member 1600 is cut and a recession 1330 (see FIG. 21) formed between the grip 1310 of the height control member 1300 and the threaded portion 1320 of the height control member 1300 is locked to the space defined between the cut portion and the edge of the second cover member 1700, such that when the grip 1310 is turned, the height control member 1300 is turned at that position.

Although the grip 1310 is operated with hand in the embodiment, the outer circumferential surface of the grip 1310 may be toothed in a gear shape and a motor may be provided to supply a driving force to the gear such that the height control member 1300 is automatically turned to control the height of the bidet nozzle unit 1100.

Figure 19:
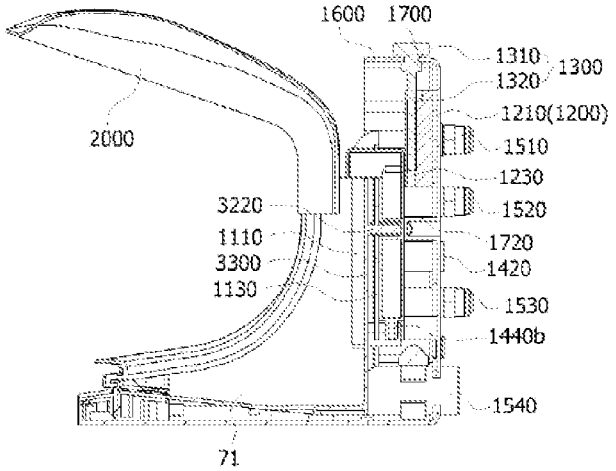
FIG. 19 is a cross-sectional view showing an automatic excreta treatment apparatus according to the present invention.
Figure 20:
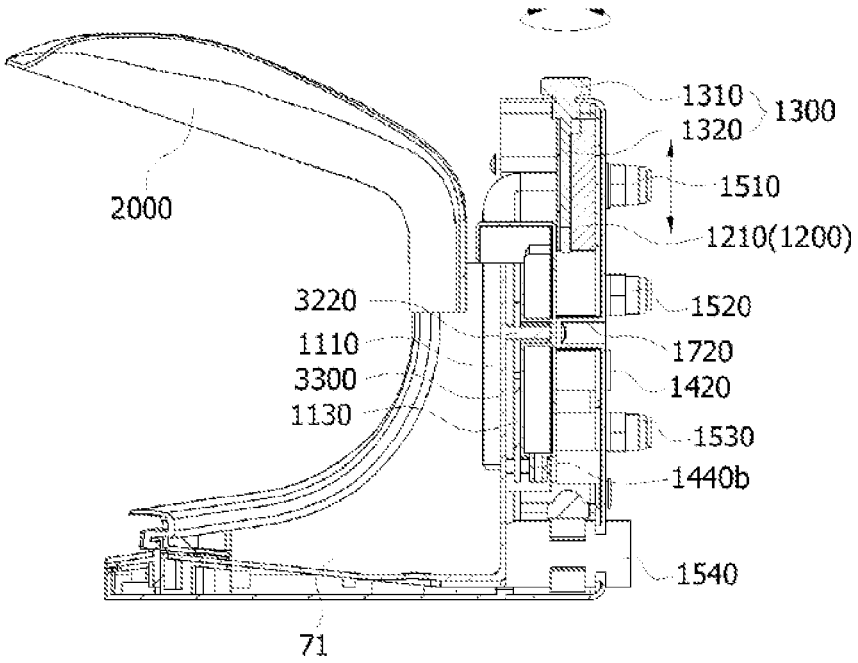
FIG. 20 is a cross-sectional view showing when bidet nozzle unit has been lifted by turning a flush handle from the state of FIG. 19.

FIG. 19 is a cross-sectional view showing an automatic excreta treatment apparatus according to the present invention and FIG. 20 is a cross-sectional view showing when the bidet nozzle unit has been lifted by turning the grip from the state shown in FIG. 19.

The grip 1310 of the height control member 1300 is locked on the first cover member 1600 and the second cover member 1700 and the threaded portion 1320 is inserted in the thread insertion hole 1230 of the nozzle pipe insertion member 1200.

When the grip 1310 of the height control member 1300 is turned by a hand from the state shown in FIG. 19, as shown in FIG. 20, the height control member 1300 is turned at that position and the bidet nozzle pipe 1110 of the bidet nozzle unit 1100 and the nozzle pipe insertion member 1200 are moved up.

When the grip 1310 is reversed from the state shown in FIG. 20, the bidet nozzle pipe 1110 of the bidet nozzle unit 1100 and the nozzle pipe insertion member 1200 are moved down into the state shown in FIG. 19.

Figure 21:
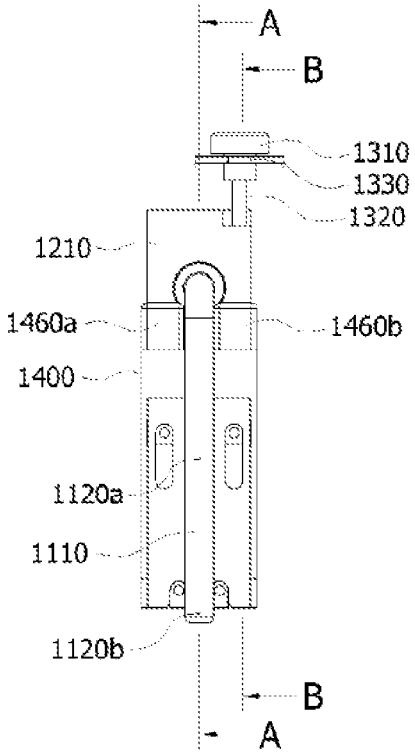
FIG. 21 is a front view showing when the bidet nozzle unit, a nozzle pipe coupling member, a height control member, and a flow channel forming member according to the present invention are combined.

FIG. 21 is a front view showing when the bidet nozzle unit, the nozzle pipe coupling member, the height control member, and the flow channel forming member according to the present invention are coupled and FIG. 22 is a cross-sectional view taken along the line A-A and B-B of FIG. 21.

The bidet nozzle pipe 1110 is positioned between the pair of upper bodies 1460*a* and 1460*b* and two nozzle holes 1120*a* and 1120*b* are formed at the upper and lower portions of the bidet nozzle pipe 1110.

A recession 1330 is formed between the grip 1310 and the threaded portion 1320 of the height control member 1300 and the recession is locked on the first cover member 1600 and the second cover member 1700.

The flow channels for air and wash water are described with reference to FIG. 22.

The wash water flowing inside through the first connection port 1510 is sprayed through the nozzle holes 1120*a* and 1120*b* after passing through the bidet nozzle pipe 1110.

Air is suctioned through the openings 1460*c* and 1460*d* by vacuum suction of the control device unit 2 and the air is sent to the control device unit 2 through the intake air connector 1410 after passing through the mixing space 1470.

The air sent to the control device unit 2 flows into the wash air connector 1420 through the excreta suctioning unit 30 and the wash air supply line 64.

The air flowing in the wash air connector 1420 is mixed with the wash water flowing inside through the wash water connector 1430 in the mixing space 1450, and the mixed air and wash water are sprayed through the wash water spray nozzle 72 to the excreta receiving portion 71 after passing through the dischargers 1440*a* and 1440*b*.

Figure 23:
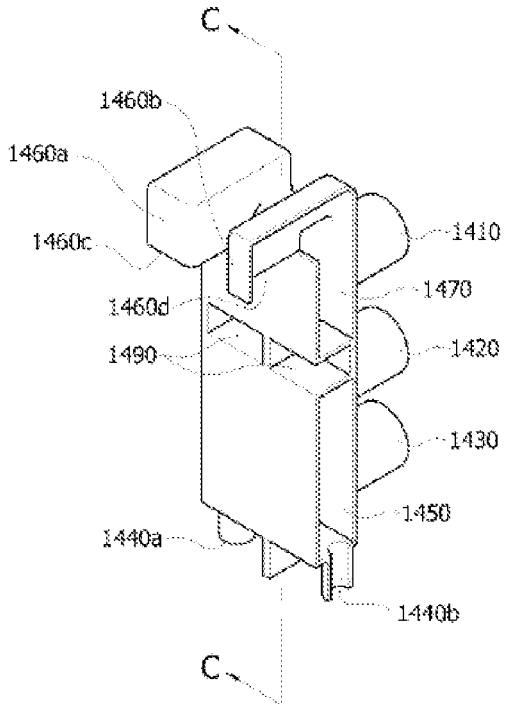
FIG. 23 is a cut perspective view showing a portion of the flow channel forming member according to the present invention.
Figure 24:
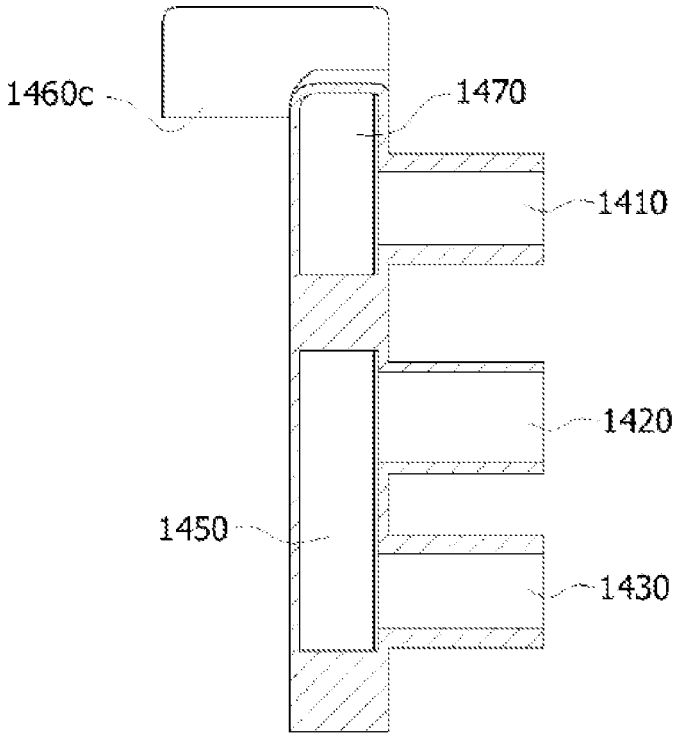
FIG. 24 is a cross-sectional view showing the inside of the flow channel forming member shown in FIG. 23.

FIG. 23 is a cut perspective view showing a portion of the flow channel forming member according to the present invention and FIG. 24 is a cross-sectional view showing the inside of the flow channel forming member shown in FIG. 23.

The flow channel forming member 1400 has, at the upper portion, the pair of upper bodies 1460*a* and 1460*b* having openings 1460*c* and 1460*d* connected to the air intake line 65 such that air is suctioned by vacuum suction of the control device unit 2, the mixing space 1470 where the air suctioned through the openings 1460*c* and 1460*d* is mixed, and the intake air connector 1410 connected to the air intake line 65 to discharge the air in the mixing space 1470 to the air intake line 65.

The pair of upper bodies 1460*a* and 1460*b* is spaced apart from each other at a predetermined distance such that the bidet nozzle pipe 1110 passes through between the upper bodies.

A pair of grooves 1490 is formed at the middle portion of the flow channel forming member 1400, and the upper mixing space 1470 and the lower mixing space 1450 are spatially divided by the groove 1490.

The wash air connector 1420 connected with the wash air supply line 64 such that air is supplied from the control device unit 2, the wash water connector 1430 connected with the wash water supply line 62 such that wash water is supplied from the control device unit 2, under the wash air connector 1420, the mixing space 1450 where the air supplied through the wash air connector 1420 and the wash water supplied through the wash water connector 1430 are mixed, and the pair of dischargers 1440*a* and 1440*b* through which the air and the wash water mixed in the mixing space 1450 are discharged are formed at the lower portion of the flow channel forming member 1400.

Figure 25:
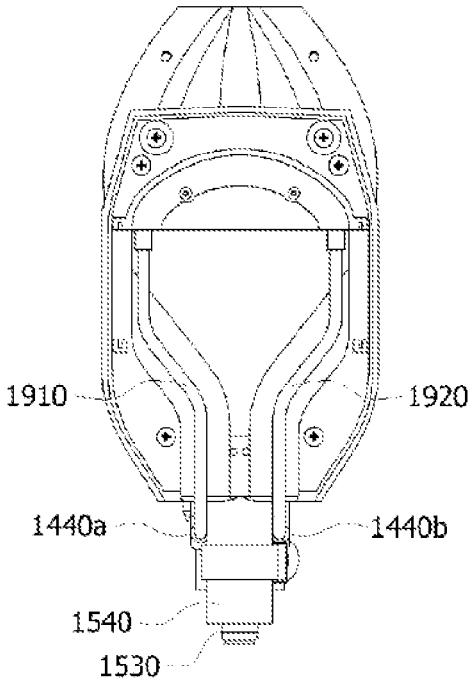
FIG. 25 is a view showing the bottom of the automatic excreta treatment apparatus according to the present invention.

FIG. 25 is a view showing the bottom of the automatic excreta treatment apparatus according to the present invention.

Tubes 1910 and 1920 are connected respectively to the dischargers 1440*a* and 1440*b* of the flow channel forming member 1400. The mixture of air and wash water which flows through the tubes 1910 and 1920 is sprayed through the wash water spray nozzle 72 and washes the excreta in the excreta receiving portion 71.

The operation of the present invention is described hereafter.

First, when a patient excretes, an excreta sensor (not shown) disposed at the excreta receiving portion 71 in the port 1 senses that it is excreta.

When the excreta is sensed, washing mode for washing the excreta and the patient's hip proceeds. When the valve unit 21 of the flow channel switching unit 20 is positioned to block the first inlet 23*a* before the washing mode proceeds, the position of the valve unit 21 is changed into the state shown in FIG. 1 to open the first inlet 23*a* and close the second inlet 23*b*.

A vacuum suction force generated by the operation of the vacuum pump 32 in the excreta suctioning unit 30 is applied to the excreta receiving portion 71 through the excreta storage unit 10 and the excreta intake line 61, such that the excreta flows into the excreta storage unit 10 through the excreta intake line 61.

Simultaneously, in the excreta receiving portion 71, the mixture of the wash water, which is supplied by the operation of the wash water supply unit 50, and the air, which is suctioned into the vacuum pump 32 and passes through the wash air supply line 64, produced in the mixing space 1450 of the flow channel forming member 1400 is sprayed through the wash water spray nozzle 72.

Further, the washing water is supplied through the bidet nozzle line 63 and then sprayed through the bidet nozzles 73, 1120*a*, and 1120*b* to wash the patient's anus and pelvic region.

The internal air circulation channel is switched by the flow channel switching unit 20 after the washing mode is finished. That is, the position of the valve unit 21 is changed, such that the excreta storage unit 10 and the excreta suctioning unit 30 are disconnected while the air intake ports 74, 1460*c*, and 1460*d* for suctioning the air in the port 1 and the excreta suctioning unit 30 are connected through the second inlet 23*b* of the flow channel switching unit 20.

Thereafter, as the excreta suctioning unit 30 is operated, a drying mode for drying the inside of the port 1 by suctioning air through the air intake ports 74, 1460*c*, and 1460*d* in the port 1 and spraying the air, which sequentially passes through the air intake line 65, second inlet 23*b* of the flow channel switching unit 20, and excreta suctioning unit 30, through the wash water spray nozzle 72 in the port 1, is performed. In this case, since the air does not pass through the excreta storage unit 10, the circulating air does not smell, such that the air in the space where there is the patient is not contaminated.

The above modes are repeated when excreta is sensed after the drying mode is finished.

INDUSTRIAL APPLICABILITY

The present invention relates to an apparatus and a method for treating excreta which can receive and automatically treat the excreta of patients and has industrial applicability because it can be used for patients or old people who have difficulty in movement in a hospital, a medical institution, a sanitarium, an asylum for the aged, and home.

The invention claimed is:

1. An apparatus for treating excreta of a patient, comprising:

a port with an excreta receiving portion for receiving the excreta of patients;

an excreta storage unit which suctions excreta from the excreta receiving portion via an excreta suctioning line and stores the suctioned excreta;

an excreta suctioning unit which is connected to the excreta storage unit to vacuum-suction the excreta; and a wash water supply unit which supplies wash water to the port to wash excreta and a bidet, wherein the port has an air spray nozzle for spraying air to the excreta receiving portion and an air intake port for suctioning air from the interior of the port, the air intake port is connected to an air intake line, and a flow channel switching unit, one side of which is selectively connected either to the excreta suctioning line or to the air intake line which are connected through the excreta storage unit, and the other side of which is connected to the excreta suctioning unit is provided;

wherein the flow channel switching unit includes:

a first inlet connected with the excreta storage unit;

a second inlet connected with the air intake line;

a valve unit selectively opening and closing the first and second inlets and; and an outlet with one side selectively connected with the first and second inlets and by opening/closing of the valve unit and the other side connected to the excreta suctioning unit.

2. The apparatus according to claim 1, wherein the valve unit of the flow channel switching unit selectively opens and closes the first inlet and the second inlet while reciprocating straight by a motor.

3. The apparatus according to claim 1, wherein the flow channel switching unit includes a first solenoid valve connected with the excreta storage unit and a second solenoid valve connected with the air intake line, and the first solenoid valve and the second solenoid valve are connected with the excreta suctioning unit.

4. The apparatus according to claim 1, wherein the excreta suctioning unit includes a filter connected with the outlet of the flow channel switching unit to purify air, a vacuum pump connected to the outlet side of the filter, and a heater heating the air discharged from the vacuum pump.

5. The apparatus according to claim 1, wherein the port has an air spray nozzle for spraying air to the excreta receiving portion and an air intake port for suctioning air from the interior of the port, the air intake port is connected to an air intake line, the excreta intake line, the excreta storage unit, the excreta suctioning unit, and the air spray nozzle are connected when excreta is washed, and the air intake line, the excreta suctioning unit, and the air spray nozzle are connected when the port is dried.

6. The apparatus according to claim 1, further comprising;

a flow channel connection member that has flow channels connected with a plurality of connection tubes, which is connected to the port and through which the wash water, the air, and the excreta flow, to allow the wash water, the air, and the excreta to the flow, that has an excreta flow channel connector connected to the flow channel through which the excreta flows, at one side to be connected with the excreta storage unit, and of which the flow channels through which the wash water and the air flow are connected to the bottom; and a base that is disposed at the control device unit and coupled to the lower portion of the flow channel connection member to be slidable to the excreta storage unit, wherein the excreta flow channel connector of the flow channel connection member and the excreta flow channel connector of the excreta storage unit come in close contact, when the flow channel connection member is coupled to the base and then slides to the excreta storage unit, with the flow channel connection member coupled to the connection tube, and the flow channels, through which the wash water and the air flows, of the flow channel connection member are connected to the tubes, through which the wash water and the air flow, in the control device unit.

7. The apparatus according to claim 6, wherein the flow channel connection member has flow channels for excreta, wash water, and air in a box-shaped body, the excreta flow channel connector of the flow channel connection member has an excreta outlet port tapered and protruding from one side of the body and a hermetic member tapered to be in close contact with the outer circumferential surface of the excreta outlet port, and the excreta outlet port and the hermetic member are inserted in an insertion hole that is an excreta connector of the excreta storage unit.

8. The apparatus according to claim 7, wherein the hermetic member is made of rubber.

9. The apparatus according to claim 6, wherein a plurality of protrusions that is tapered to form the flow channels for air and wash water is formed on the bottom of the flow channel connection member, and the base includes:

a flat plate-shaped body being in close contact with the bottom of the flow channel connection member;

a plurality of protrusions that protrudes up from the body to correspond to the protrusions of the flow channel connection member and overlaps the protrusions at a predetermined thickness to be hermetic with the protrusions; and a plurality of tube connection members that has tube connectors connected downward from the protrusions and protruding downward with a predetermined length from the body.

10. The apparatus according to claim 9, wherein the tube connection member is made of rubber.

11. The apparatus according to claim 9, wherein a locking portion, which prevents the flow channel connection member and the base, which slide to the excreta storage unit, from moving in the opposite direction, is formed at one side of the base.

12. The apparatus according to claim 11, wherein the locking portion includes:

a locking member that is restricted in forward movement by a locking step pivoting upward about a pivot center at one end, when the flow channel connection member and the base slide rearward to the excreta storage unit;

a spring elastically supporting upward the locking member, a spring support member supporting the lower end of the spring, and a hinge shaft inserted in the pivot center of the locking member.

13. The apparatus according to claim 9, wherein the tube connection member includes: at the lower portion, a support bracket that has a flat plate-shaped body with a plurality of through-holes to allow the tube connectors of the tube connection member to be inserted, bending flanges formed at the edge of the body, and a plurality of supporter holes having a predetermined size;

supporters that support the bottom of the support bracket, with the upper ends partially inserted in the supporter holes; and a sliding member that has a bottom body where the bottoms of the supporters are fixed, through-holes formed to correspond to the through-holes of the support bracket such that the tube connectors of the tube connection member are inserted, and sliding portions formed at both sides of the bottom body and sliding forward and backward.

14. The apparatus according to claim 13, wherein the flow channel connection member includes a coupling member having a locking hook that is pivotable while being coupled to one side of the body, and the locking hook is locked to an n-shaped locking hook connector, at the flange at one side of the support bracket.

15. The apparatus according to claim 1, further comprising:

a flow channel connector in which a bidet nozzle unit, which includes a bidet nozzle pipe connected by a plurality of connection lines through which air and wash water flow into the control device unit, and having two or more nozzle holes vertically formed to spray wash water supplied through the bidet nozzle line in the connection lines, is disposed to be vertically movable;

a mounting member disposed ahead of the flow channel connector to come in close contact with the patient's hip; and an excreta receiving main body coupled to the lower portion of the mounting member and having the excreta receiving portion to receive excreta from the patient.

16. The apparatus according to claim 15, further comprising:

a nozzle pipe coupling member having a nozzle pipe insertion hole where the connector of the bidet nozzle pipe is inserted and a thread insertion hole having the inner side threaded vertically in a predetermined length; and a height control member having a threaded portion inserted in the thread insertion hole and turning such that the bidet nozzle unit and the nozzle pipe coupling member integrally and vertically move.

17. The apparatus according to claim 16, wherein a grip that is turned with hand is formed or a gear portion is connected to the upper end of the threaded portion of the height control member such that the threaded portion is turned by a motor.

18. The apparatus according to claim 16, wherein the thread insertion hole is positioned at the edge of the nozzle pipe coupling member and prevents interference with the threaded portion of the height control member and the connector of the bidet nozzle pipe.

19. The apparatus according to claim 16, wherein a vertical plate having a plurality of protrusions with threaded holes is disposed between the flow channel connector and the mounting member, a support plate integrally formed with the bidet nozzle pipe and having oblong holes that are vertically longer than the diameter of the protrusions is positioned opposite the bidet nozzle pipe with the vertical plate therebetween, and a flow channel forming member is thread-fastened in the threaded holes of the protrusions inserted in the oblong holes, and connected with the wash water supply line, the wash air supply line, and the air intake line in the connection lines.

20. The apparatus according to claim 19, wherein the flow channel member has a pair of upper bodies having openings connected to the air intake line such that air is suctioned by vacuum suction of the control device unit, a mixing space where the air suctioned through the openings is mixed, and an intake air connector connected to the air intake line to discharge the air in the mixing space to the air intake line.

21. The apparatus according to claim 20, wherein the pair of upper bodies is spaced apart from each other at a predetermined distance and the bidet nozzle pipe passes through between the upper bodies.

22. The apparatus according to claim 19, wherein the flow channel forming member has a wash air connector connected with the wash air supply line such that air is supplied from the control device unit, a wash water connector connected with the wash water supply line such that wash water is supplied from the control device unit, under the wash air connector, a mixing space where the air supplied through the wash air connector and the wash water supplied through the wash water connector are mixed, and a pair of dischargers through which the air and the wash water mixed in the mixing space are discharged.

23. The apparatus according to claim 16, wherein the flow channel connector includes a first cover member, a second cover member jointed opposite the first cover member, and a third cover member coupled with the first and second cover members, the bidet nozzle unit and the nozzle pipe coupling member are positioned in the space defined by the first cover member, the second cover member, and the third cover member, a grip for turning the height control member with hand is formed at the upper end of the threaded portion, and the grip and the threaded portion are locked on the first cover member and the second cover member, such that the height control member turns at that position.

24. A method of treating excreta, using an apparatus for treating excreta including: a port with an excreta receiving portion for receiving the excreta of patients; and a control device unit composed of an excreta storage unit which suctions excreta from the excreta receiving portion via an excreta suctioning line and stores the suctioned excreta, an excreta suctioning unit which is connected to the excreta storage unit to vacuum-suction the excreta, and a wash water supply unit which supplies wash water to the port to wash excreta and a bidet, the method comprising:

(a) sensing excreta of a patient in the port;

(b) performing a washing mode for washing the excreta and the patient by operating the excreta suctioning unit for vacuum-suctioning the excreta by sensing the excreta;

(c) switching an internal air circulation channel by using the flow channel switching unit after the washing mode is performed; and (d) performing a drying mode of circulating air for drying the inside of the port after the flow channel is switched while the excreta storage unit storing the excreta is blocked.

25. The method according to claim 24, wherein in the washing mode of step (c), wash water for washing the excreta and the patient is sprayed, the excreta flows into the excreta storage unit by operation of the excreta suctioning unit, and the air in the excreta storage unit is sprayed through the air spray nozzle of the port through the excreta suctioning unit.

26. The method according to claim 24, wherein in step (c), the excreta storage unit and the excreta suctioning unit are disconnected, and the air intake port and the excreta suctioning unit for suctioning the air in the port are connected.

27. The method according to claim 24, wherein in the drying mode of step (d), the air is suctioned through the air intake port formed in the port and then sprayed through the air spray nozzle formed in the port after sequentially passing through the flow channel switching unit and the excreta suctioning unit, by operating the excreta suctioning unit.

* * * * *